52-489 SA
10/15/85 OR 4,546,587

United States Patent [19]

Mosch

[11] Patent Number: 4,546,587

[45] **Date of Patent: * Oct. 15, 1985**

[54] SYSTEM WALL OR SYSTEM CEILING

[76] Inventor: Theodorus W. Mosch, Kanaalkade 66, t'Zand, Netherlands

[ * ] Notice: The portion of the term of this patent subsequent to Nov. 2, 1999 has been disclaimed.

[21] Appl. No.: 438,567

[22] Filed: Nov. 2, 1982

Related U.S. Application Data

[63] Continuation of Ser. No. 134,810, Mar. 28, 1980, Pat. No. 4,356,677.

[30] Foreign Application Priority Data

Dec. 27, 1979 [NL] Netherlands ..... 7909311

[51] Int. Cl.[4] ..... E04B 5/57

[52] U.S. Cl. ..... 52/489; 52/775

[58] Field of Search ..... 52/489, 775, 482, 444, 52/484, 486, 715, 762, 764, DIG. 6, 765, 778, 363, 361, 356

[56] References Cited

U.S. PATENT DOCUMENTS

| | | | |
|---|---|---|---|
| 344,408 | 6/1886 | Scarles | 52/715 |
| 1,974,259 | 6/1932 | Cherry | 52/765 |
| 2,074,442 | 3/1937 | Venzie | 52/489 |
| 2,133,002 | 3/1936 | Wallace et al. | 52/508 |
| 2,150,459 | 3/1939 | Reintjes | 52/778 |
| 2,150,997 | 2/1933 | Venzie | 52/483 |
| 2,209,514 | 7/1940 | Drummond | 52/483 |
| 2,282,624 | 5/1942 | Upson | 52/361 |
| 2,581,843 | 1/1952 | Edwards | 52/775 |
| 2,699,740 | 1/1955 | Weber | 52/489 |
| 3,005,293 | 4/1959 | Hunter | 52/489 |
| 3,175,656 | 3/1965 | Schoenfeld | 52/778 |
| 3,248,838 | 5/1966 | Stark . | |
| 3,277,622 | 12/1962 | Jensen | 52/778 |
| 3,473,283 | 1/1968 | Meyer | 24/295 |
| 3,594,028 | 7/1971 | Scott | 52/465 |
| 4,033,083 | 7/1977 | Fritz et al. | 52/385 |

FOREIGN PATENT DOCUMENTS

| | | | |
|---|---|---|---|
| 561466 | 10/1957 | Belgium | 52/385 |
| 109907 | 7/1968 | Denmark | 52/489 |
| 6939664 | 9/1969 | Fed. Rep. of Germany . | |
| 7221820 | 5/1972 | Fed. Rep. of Germany . | |
| 2752963 | 5/1979 | Fed. Rep. of Germany . | |
| 2825705 | 12/1979 | Fed. Rep. of Germany . | |
| 975236 | 10/1950 | France | 52/489 |
| 51596 | 2/1911 | Switzerland . | |
| 426170 | 6/1967 | Switzerland . | |

*Primary Examiner*—John E. Murtagh
*Assistant Examiner*—Kathryn Ford
*Attorney, Agent, or Firm*—Pollock, Vande Sande & Priddy

[57] ABSTRACT

A system wall or system ceiling comprising a number of supporting girders suspended from the structure of the building and to which slabs are mounted substantially extending perpendicular to the girders, the girders being provided with outwardly or downwardly protruding clamping feet engaging one or more slits, cut into the upper or back side of the slabs.

9 Claims, 4 Drawing Figures

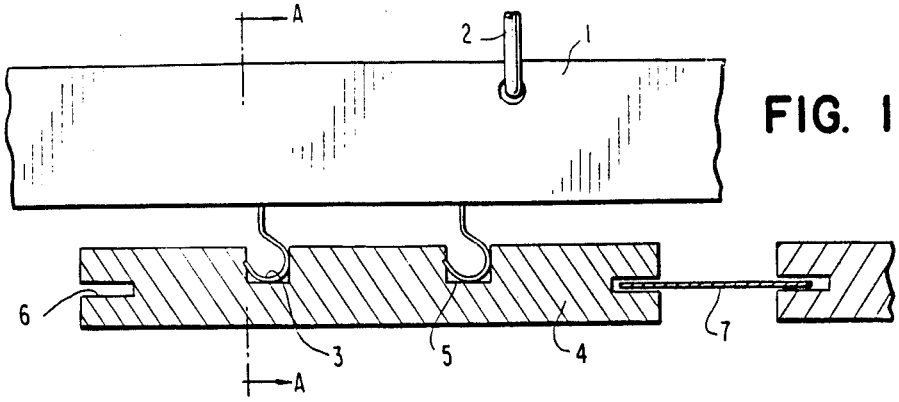
FIG. 1
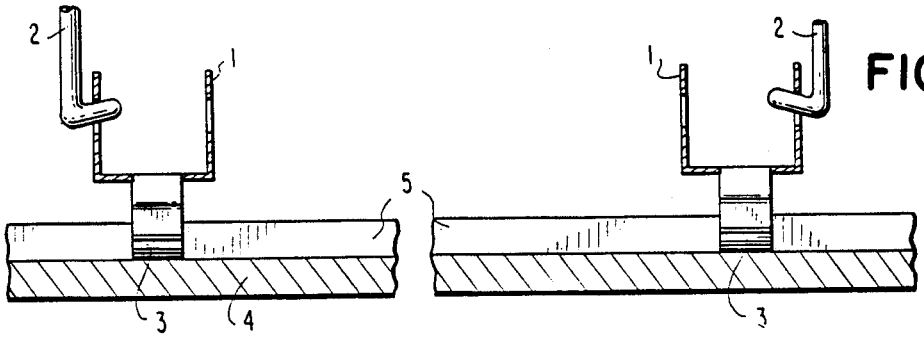
FIG. 2
FIG. 3
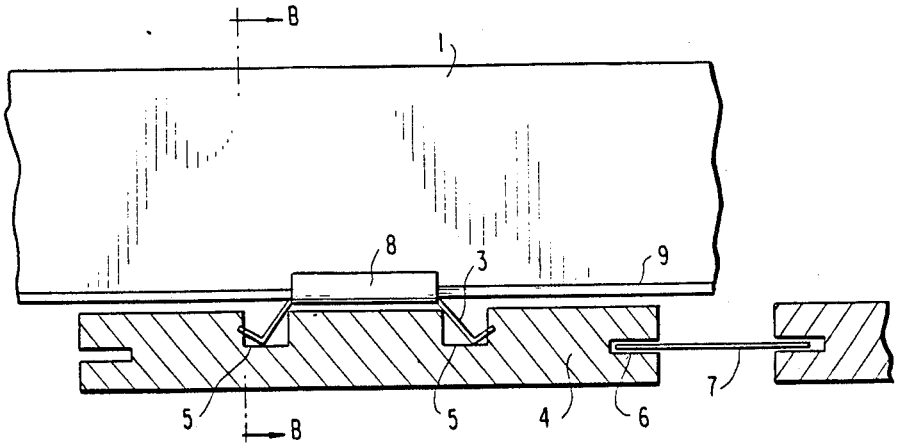
FIG. 4
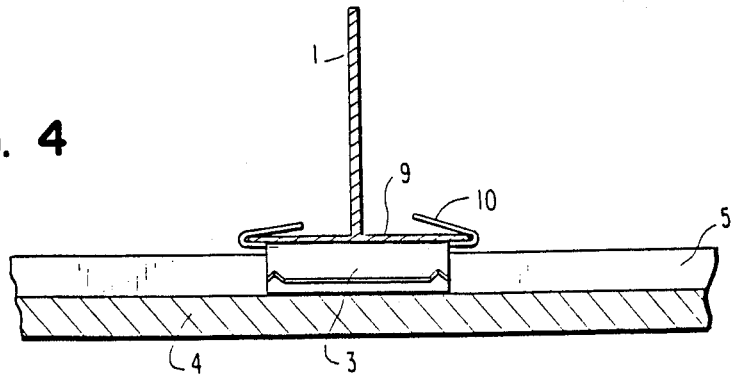

SYSTEM WALL OR SYSTEM CEILING

This is a continuation, of application Ser. No. 134,810, filed 3/28/80 now U.S. Pat. No. 4,356,677 issued 11.2.82.

BACKGROUND OF THE INVENTION

The present invention relates to a system wall or system ceiling comprising a number of supporting girders suspended from the structure of the building and to which slabs are mounted substantially extending perpendicular to the girders. Such a system ceiling is known in which the slabs are mounted to the girders by means of fastening members clamped or pushed onto the girders and which are provided with sheet metal strips directed downwardly to the slabs, and of which the end portions flanged at right angles engage saw cuts applied into the sides of the slabs.

This manner of mounting the slabs to the girders has the drawback, that on occurrence of shrinkage or buckling of the slabs, these slabs become insufficiently retained by the fastening members and may shift with respect to each other, so that the spacing between the succeeding slabs which are generally bridged by the so called firet strips, will show differences.

By the firet strips which, to obtain a decorative effect, may have a contrasting tint with respect to the slabs, and which also are slipped into the saw cuts at the sides of the slabs, the mutual differences in spacing between the slabs further is accented.

Also, on shrinkage of the slabs, the firet strips may become free from the saw cuts, which causes a very defacing effect to the known system ceiling.

It is an object of the present invention to remove these drawbacks of the known system ceiling.

SUMMARY OF THE INVENTION

According to the present invention the system wall or system ceiling is characterized in that the girders are provided with outwardly or downwardly protuding clamping feet engaging into one or more slits, cut into the upper or back side of the slabs.

To apply the slabs to the girders suspended from the structure of the building, the slabs may simply be pressed with the slits across the clamping feet of the girders.

In a favourable embodiment of the invention, the clamping feet are formed by sheet metal strips of which the ends are bent to form barbs.

In this embodiment the slabs, after being pressed across the clamping feet, are efficiently prevented from moving back, and a firm connection between the slabs and the girders is ensured.

In another favourable embodiment of the invention, the ends of the clamping feet cooperating with the slabs are bent in opposite directions and substantially perpendicular to the length direction of the slabs and the slits cut therein, to form oppositely directed barbs.

In this embodiment the clamping feet introduced into the slits hook into both opposite side walls of the slits so that a double security is obtained against the losening of the clamping feet from the slabs.

The number of slits in a slab for cooperating with the clamping feet may vary.

Preferably two axially extending slits are applied which are spaced and symmetrical with respect to the middle plane of the slabs.

In the ceiling system of the present invention, the slabs are completely secured against shifting by the mounting by clamping feet introduced into the slits at the upper or back side of the slabs, so that the drawbacks of the known systems are completely met.

The clamping feet may be connected to the sheet metal girders in various manners.

In a favourable embodiment of the invention, the clamping feet form a whole with the girders.

Favourably, in this embodiment, the clamping feet may have been punched from the girders.

In another embodiment of the invention, the slabs are mounted to the girders by means of fastening members, each comprising a substantially rectangular an planar base or middle portion having two pairs of opposite edges one pair of opposite edges are connected to fastening lips which, in use, are bent around the flange of the cooperating profile sheet metal girder.

The other pair of opposite edges are connected to the clamping feet.

BRIEF DESCRIPTION OF THE DRAWINGS

Two embodiments of the invention are illustrated by way of example in the accompanying drawing, of which FIG. 1 is a sectional view through the slabs of a ceiling in accordance with a first embodiment of the invention.

FIG. 2 is a sectional elevation according to line A—A of FIG. 1.

FIG. 3 is a sectional elevation through the slabs of a ceiling according to a second embodiment of the invention.

FIG. 4 is a sectional elevation according to line B—B of FIG. 3.

DETAILED DESCRIPTION OF THE PREFERRED EMBODIMENT

As is shown in FIG. 1 and FIG. 2, the system ceiling is formed by a row of profile sheet metal girders 1 extending parallel to and spaced from each other, and which are suspended from the structure of the building by suitable anchors 2.

From the -U- shaped girders 1 clamping members such as feet 3 are punched with ends bent to form barbs which hook into the slits 5 at the upper side of the slabs 4. As shown in FIGS. 1 to 4 and described in part previously herein, slits 5 open on the side of slab 4 which confronts girder 1 and comprise oppositely facing side walls extending downward to a bottom wall. The walls of the slits are parallel to each other and the slits are spaced apart by a predetermined distance.

The slabs 4 are provided at the sides with saw cuts 6 into which the firet strips 7 have been slipped. To mount the system ceiling, the girders 1 may be suspended first from the structure of the building, after which the slabs 4 are pressed until the slits 5 receive the clamping feet 3.

It also is possible to first prepare the complete ceiling on the floor and then to suspend same from the structure of the building by means of the anchors 2.

As is shown in FIG. 3 and in FIG. 4, the slabs 4 are mounted to the girders 1 by means of the fastening members 8 which are provided with the clamping feet 3 for engaging the slabs 4 and which are clamped around the flange 9 of a plurality of spaced profile sheet metal girder 1 by means of the fastening or clamping lips 10. As shown in FIGS. 3 and 4, the clamping feet 3 terminate in barbed ends which assist in penetrating the sidewalls of slits 5.

What is claimed is:

1. Apparatus for attaching deformable slabs to structural girders to form walls or ceilings, said apparatus comprising:

a plurality of separate slabs each defined in part by generally parallel substantially planar surfaces; each slab having a pair of spaced, parallel, oppositely facing walls extending in length along the surface thereof which confronts said structural girders; said walls extending in depth from said girder-confronting surface toward the opposite surface of said slab and terminating at a bottom wall;

a plurality of spaced clamping members, each of said members have a first means which engages said structural girders, and a second means which engages said slabs;

said first means having a pair of adjacently disposed and deformable fastening lips which are integrally joined to one another by a substantially planar base portion extending therebetween, said deformable fastening lips being adapted to be deformed around said structural girder on either side thereof to secure said clamping member to said girder; and said second means defining a pair of oppositely angled clamping feet, each of said angled clamping feet extending outwardly from said substantially planar base portion, said pair of angled clamping feet being spaced apart from one another to span said predetermined distance between said oppositely facing walls, each of said angled clamping feet having a first portion joined to said planar base portion and inclined over a substantial first portion of its length both toward said bottom wall and toward the associated one of said pair of oppositely facing walls, each of said angled clamping feet having a second, oppositely inclined portion forming an extension of said first portion that angles away from said bottom wall having at its free end means for penetrating and into the respective one of said oppositely facing walls, whereby slight pressure against each slab in the direction of the confronting structural girder is sufficient to engage said second inclined portions with said oppositely facing walls of said slab to thereby secure said slab to said clamping feet.

2. Apparatus for attaching slabs to structural girders as claimed in claim 1, wherein said walls extend substantially the length of said slabs.

3. Apparatus for an improved wall or ceiling system, comprising:

a plurality of parallel supporting girders adapted to be attached to a building structure;

a plurality of slabs each defined in part by generally parallel and substantially planar opposing surfaces adapted to extend perpendicularly to said girders; each of said slabs having a pair of spaced, oppositely facing, parallel walls extending along the surface thereof which confronts said girders; said walls extending in depth from said girder-confronting surfaces of said slab toward the opposite surface of said slab and terminating at a bottom wall, a plurality of clamping means protruding outwardly from said supporting girders toward said girder-confronting surfaces of said slabs;

each of said clamping members engaging a respective one of said oppositely facing walls on a single slab and comprising at least one pair of resilient outwardly extending, oppositely directed flange means; each flange means having a first portion which, over a substantial portion of its length, is inclined both toward said bottom wall and toward the associated one of said pair of oppositely facing walls and a second portion adjoining said first portion which angles away from said bottom wall and toward the associated one of said oppositely facing walls, each flange means having a free end with a sharp barb; said barb being directed and positioned to penetrate the material of the associated one of said oppositely facing walls when said pair of resilient flange means is distorted by pressing said single slab toward said girders into engagement with said resilient flange means.

4. A system according to claim 3, wherein said pair of resilient flange means comprises two free ends each of which engages one of said oppositely facing walls substantially perpendicularly to the direction of said walls.

5. A system according to claim 3, wherein said oppositely facing walls are located in spaced channels in said slabs.

6. A system according to claim 3, wherein said clamping members comprise a substantially rectangular midportion having a first pair of opposite sides from each of which one of said resilient flange means extends, said resilient flange means being integral with said midportion.

7. A system according to Claim 6, wherein said midportion comprises a second pair of opposite sides from each of which extends a deformable fastening lip for engaging said girders.

8. In apparatus for an improved wall or ceiling system in which a plurality of longitudinally extending slabs is supported in a parallel, edge-adjoining manner to form a decorative wall or ceiling surface, each of said slabs being defined in part by generally parallel and substantially planar opposing surfaces and each having a pair of spaced, oppositely facing, substantially parallel walls extending along the rear surface thereof, said walls extending in depth substantially perpendicularly from said rear surface of each said slab toward the opposite surface of said slab and terminating at a bottom wall, the improvement of supporting means for said slabs comprising:

a plurality of parallel supporting girders adapted to be attached to a building structure;

a plurality of clamping means protruding outwardly from said supporting girders toward said rear surfaces of said slabs;

each of said clamping members engaging a respective one of said oppositely facing walls on a single slab and comprising at least one pair of resilient outwardly extending, oppositely directed flange means; each flange means having a first portion which, over a substantial portion of its length, is inclined both toward said bottom wall and toward the associated one of said pair of oppositely facing walls and a second portion adjoining said first portion which angles away from said bottom wall and toward the associated one of said oppositely facing walls, each flange means having a free end with a sharp barb; said barb being directed and positioned to penetrate the material of the associated one of said oppositely facing walls when said pair of resilient flange means is distorted by pressing said single slab toward said girders into engagement with said resilient flange means.

9. The system of claim 8 in which said clamping means is formed separately from said girders and each includes means for detachable coupling to said girder means.

* * * * *